United States Patent [19]

Harley

[11] Patent Number: 5,058,287

[45] Date of Patent: Oct. 22, 1991

[54] REGISTER SYSTEM AND METHOD FOR FLEXOGRAPHIC PRINTING PLATES

[76] Inventor: Richard Harley, 200 East 74th Street, New York, N.Y. 10021

[21] Appl. No.: 570,572

[22] Filed: Aug. 21, 1990

[51] Int. Cl.[5] ..... B41B 11/00

[52] U.S. Cl. ..... 33/618; 33/623

[58] Field of Search ..... 33/618, 623, 614, 615

[56] References Cited

U.S. PATENT DOCUMENTS

| | | | |
|---|---|---|---|
| 1,070,669 | 8/1913 | Cundall | 33/618 |
| 2,632,957 | 3/1953 | Gardner | 33/618 |
| 2,711,691 | 6/1955 | Leavens | 33/618 X |

*Primary Examiner*—Harry N. Haroian

*Attorney, Agent, or Firm*—Jordan and Hamburg

[57] ABSTRACT

In system and method for registering a flexographic printing plate on a printing cylinder, the printing plate is provided with two alignment holes. A first registration pin is moved with a precision adjustment device to a predetermined location adjacent the cylinder. One of the alignment holes is aligned with the first pin, and the first pin is moved into that hole. The printing plate is then adjusted to move the other hole into alignment with a second registration pin, and the second pin is moved into the other hole. The plate is then adhered to the printing cylinder, and the registration pins withdrawn.

14 Claims, 5 Drawing Sheets

3
59
44
50
45
150
151
60
36
34
37
145
38
33
39
146
141
31
103
104
103
30
129
128
126
102
120
125
127
3
130

REGISTER SYSTEM AND METHOD FOR FLEXOGRAPHIC PRINTING PLATES

FIELD OF THE INVENTION

This invention relates to improvements in the mounting and registration of flexographic printing plates on a printing cylinder, and to a method for employing such apparatus.

BACKGROUND OF THE INVENTION

One well known printing technique, especially adapted for color printing, employs flexible printing plates adapted to be mounted on a printing cylinder. Such flexible printing plates, known as flexographic plates, may be photographically prepared, and are adapted to be held to a printing cylinder by conventional means, for example by double sided adhesive tape. Flexographic printing plates, which the present invention also employ, may be comprised of a photopolymer plate mounted on a Mylar substrate for stability.

Printing cylinders having flexographic plates corresponding to different colors to be printed are mounted on different printing cylinders. It is therefore necessary that printing plates corresponding to different printing colors be precisely positioned on their respective printing cylinders.

In one mounting technique, disclosed in U.S. Pat. No. 4,589,338, flexographic plates are provided with registration holes, and directed from a positioning tray onto the surface of a register cylinder. The register cylinder has a row of predrilled registration holes drilled therein. The holes in the plates are aligned with holes in the register cylinder, and pins are inserted therein to hold the plate to this cylinder. This cylinder is then rotated to align the plate with a printing cylinder having a double sided adhesive tape, and the adhesive tape effects the transfer of the printing plate to the printing cylinder. Pressure from the printing cylinder effects the retraction of the registration pins into the register cylinder, to enable the full release of the plate from the register cylinder.

U.S. Pat. No. 4,727,806 discloses a further apparatus for precisely aligning a flexographic plate on a printing cylinder, also wherein the printing plates are provided with registration holes. In this arrangement, the printing cylinder itself is provided with row of precisely spaced holes, and the plates are initially aligned with alignment pins fit into the holes in the cylinder and extending into the holes in the plates. The plate is held to the cylinder by double sided adhesive tape, and the registration pins are either withdrawn or their heads are lowered, when the cylinder is used for printing.

In each of the above arrangements, holes with fixed locations must be provided in the printing cylinder or a register cylinder, thereby limiting the positioning capabilities of the arrangement. In addition, in the latter arrangement, the registration of the plates disadvantageously requires the drilling of a row of holes in each printing cylinder, only a few of which are employed in any given printing operation. The inflexibility of the locations of the pins and holes in the flexographic plates also lengthened the time to set up a printing cylinder.

In order to provide holes in the printing cylinder, is has been generally necessary for a printer to send the cylinder to a machine shop, so that, in addition to limiting the design capabilities of the cylinder, the cost of the provision of a drilled cylinder was also increased. If a pin in such a cylinder loosens during use, it can ruin the cylinder, thereby resulting in an great economic loss to the printer.

SUMMARY OF THE INVENTION

The invention is directed to the provision of a method and system for overcoming the above disadvantages in prior registration systems and methods.

Briefly stated, in accordance with the invention, a system is provided for registering a flexographic printing plate on a printing cylinder, including a frame for rotatably mounting a printing cylinder. Two registration pins are mounted for movement longitudinally of the printing cylinder, and a precision measuring device is provided for displaying the longitudinal position of at least one of the registration pins. The mounting arrangement includes means for adjusting the pins to first positions abutting the cylinder and second positions spaced from the cylinder.

The mounting arrangement may means comprises guides, such as guide rods, extending longitudinally of the printing cylinder, first and second brackets mounted on the guides, means for mounting the registration pins to separate brackets. A lead screw is provided for adjusting the position of one of the brackets. The arrangement for mounting the registration pins may include slides on the brackets, the slides being adjustable toward and away from the printing cylinder. The pins are mounted to the slide, preferably being resiliently biased toward the printing cylinder.

In a method in accordance with the invention for mounting a flexographic printing plate to a printing cylinder, the printing plate is provided with a pair of holes adjacent opposite sides thereof. One of the pins is positioned adjacent a predetermined location on the printing cylinder. One of the holes is then aligned with the first pin and the first pin is moved into this hole, moving the first pin to enter the first hole. The other hole is then aligned with the other pin, and the other pin is moved into this hole. The printing plate is then adhered to the printing cylinder, and the pins are withdrawn from the holes.

BRIEF DESCRIPTION OF THE DRAWING

In order that the invention may be more clearly understood, it will now be disclosed in greater detail with reference to the accompanying drawing, wherein.

DETAILED DISCLOSURE OF THE INVENTION

Figure 1:
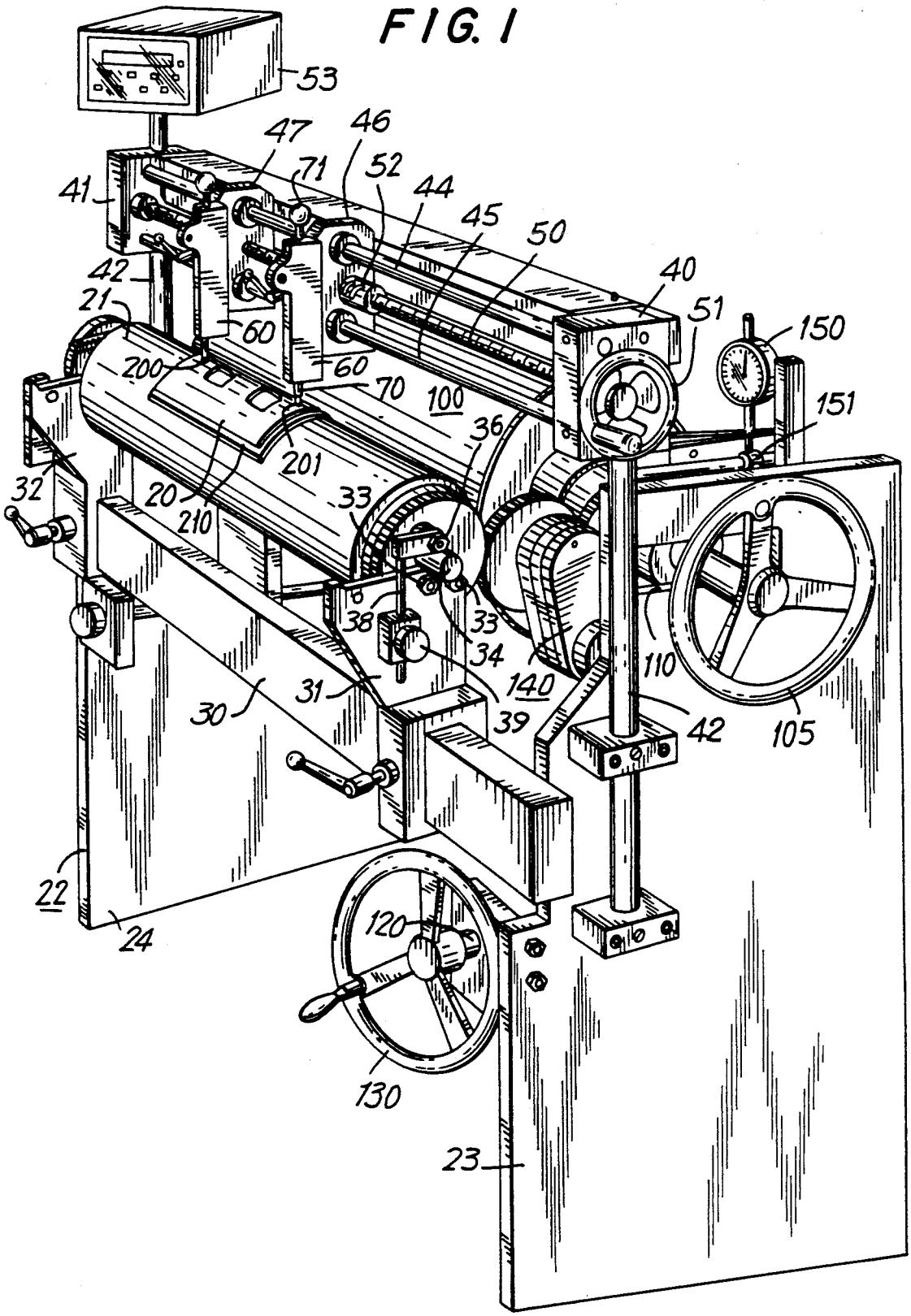
FIG. 1 is a perspective view of a register system for flexographic plates in accordance with the invention.
Figure 2:
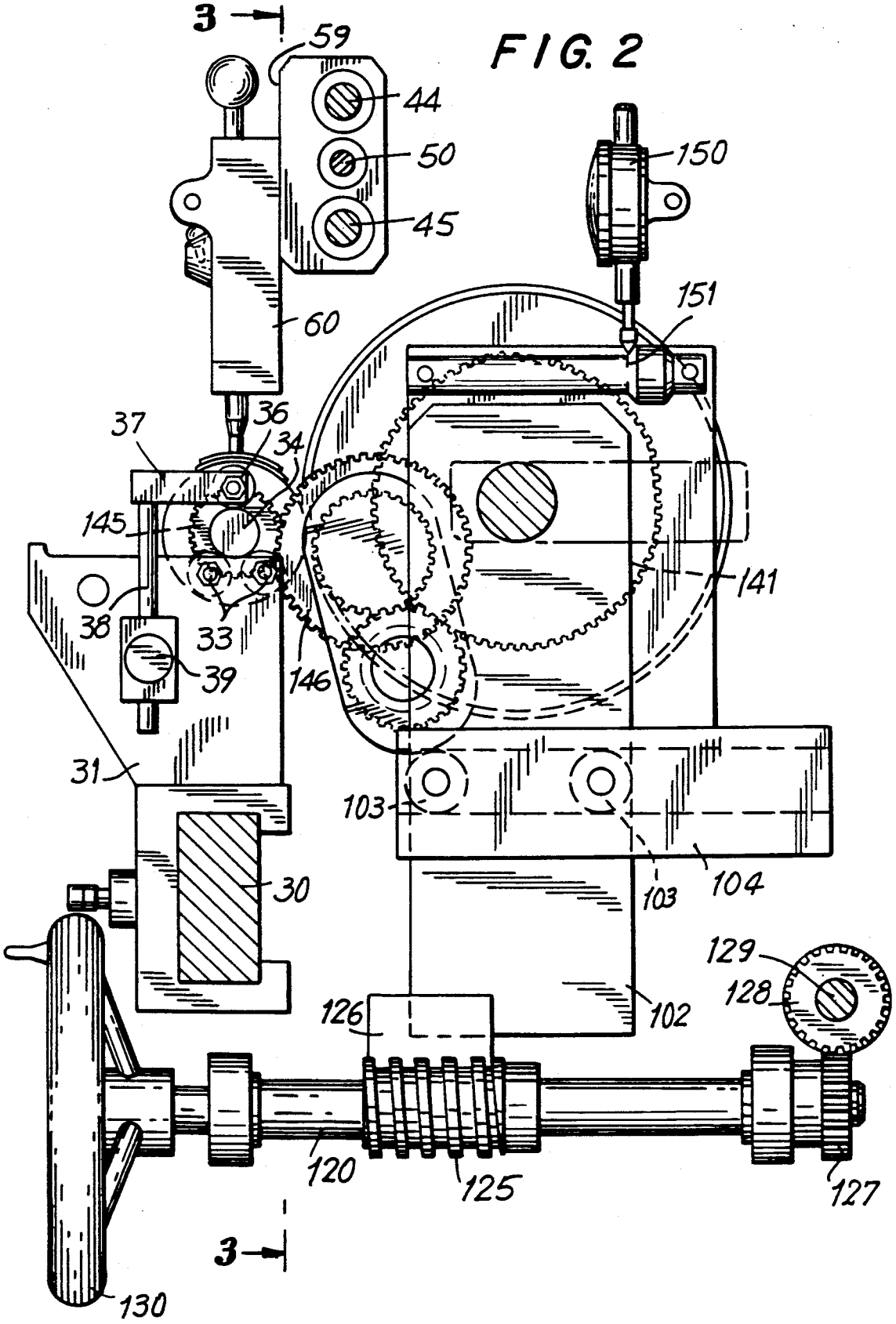
FIG. 2 is a partially cross sectional view of the system of the invention, taken along the lines 2—2 of FIG. 3.
Figure 3:
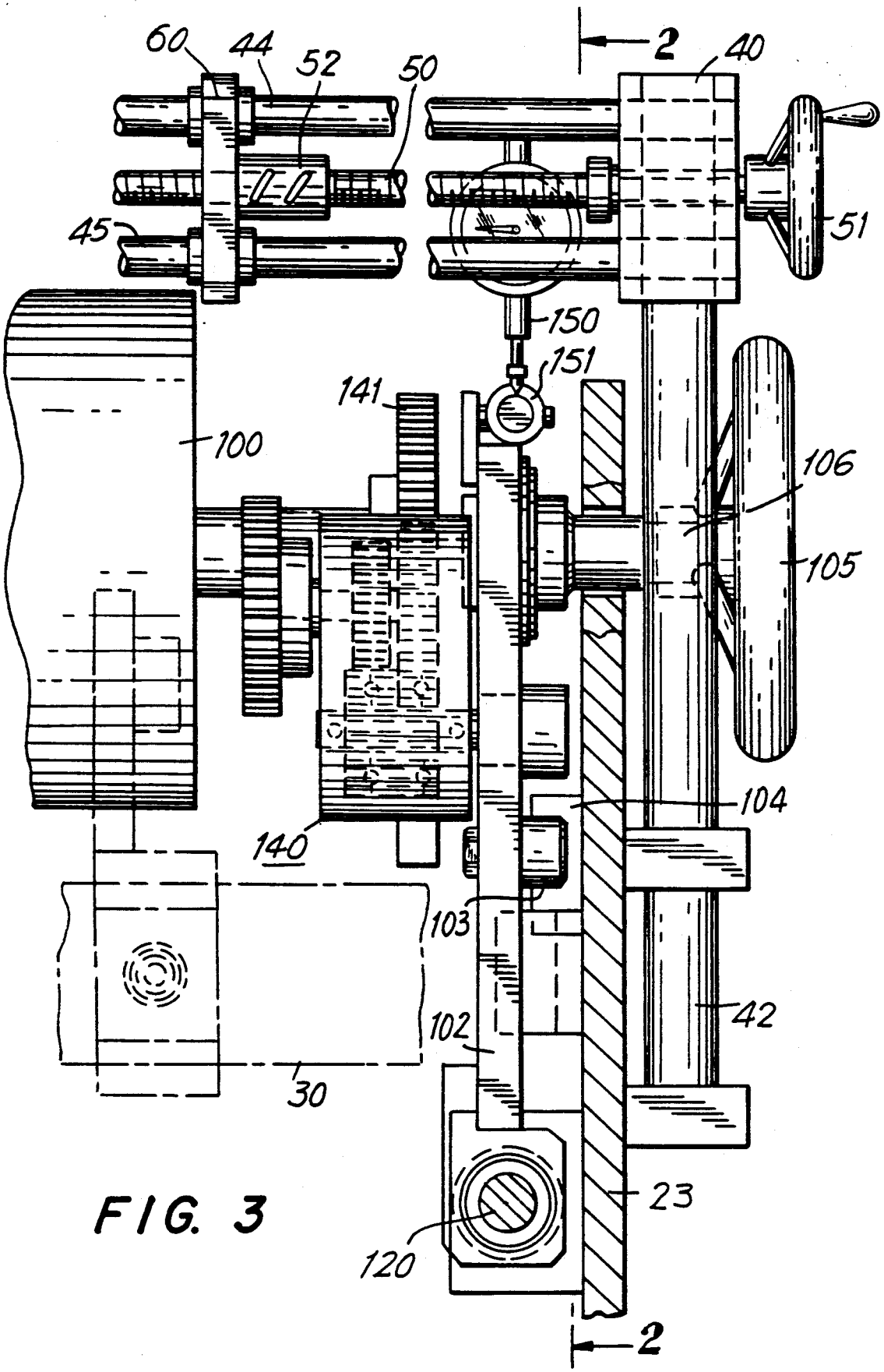
FIG. 3 is a partially cross sectional view of the system of the invention, taken along the lines 3—of FIG. 2.

Referring now to the drawings, therein is illustrated a register and mounting apparatus in accordance with the invention, for accurately positioning and mounting a flexographic printing plate 20 on a printing cylinder 21.

The apparatus includes a frame (22) having right and left end plates 23, 24.

The printing cylinder 21 is removably mounted to the frame (22). In the illustrated embodiment of the invention, a front beam 30 is affixed to extend between the end plates 23, 24, the beam 30 laterally adjustably supporting a pair of upwardly extending brackets 31, 32. The upper edges of the brackets 31, 32 are provided with lower bearings 33 for rotatably supporting the end shaft 34 of the printing cylinder, and an upper bearing 36 is releasably mounted to each of the brackets to enable the printing cylinder to be removed from the register and mounting apparatus. For example, as illustrated, the bearing 36 may be held to a forwardly extending arm 37 supported on the upper end of a rod 38, the rod 38 being guided in a hole in the respective bracket. A manually adjustable clamp screw 39 permits release of the rod 38, so that the upper bearing may be readily moved into and out of engagement with the shaft of the printing cylinder. This arrangement enables the mounting of printing cylinders of different sizes in the apparatus.

It will be apparent, of course, that other arrangements may be provided for removably mounting the printing cylinder to the frame, without departing from the invention.

Right and left guide blocks 40,41 are affixed to the sides of the apparatus of the invention. For example, the guide blocks 40, 41 may be held at the upper end of support shafts 42, the support shafts being mounted to the outer sides of the end plates 23, 24 by conventional means. Upper and lower parallel vertically spaced apart guide rods 44, 45 extend between the guide blocks 40, 41, for slidably guiding left and right pin support brackets 46, 47 for lateral movement, parallel to the axis of the printing cylinder. A lead screw 50 extends between the guide blocks 40, 41, the lead screw being manually rotatable by the hand wheel 51 positioned at the right side of the guide block 40. A ball nut 52 is provided on the right pin support bracket 46, engaging the lead screw, enabling the accurate positioning of the pin support bracket 46, for example within 0.0001 inch. In order to enable the accurate determination of the lateral position of the pin support bracket 46, a gauge 53 is mounted to the left guide block 41, and coupled to the lead screw by conventional techniques. The gauge 53 may be a conventional gauge, for example a Gemini 1000 digital gauge supplied by Red Lion Controls, York, Pa. 17402. The gauge preferably has an illuminated dial, for example using LEDs, to provide a measurement responsive to the angular displacement of the lead screw, and may be readily reset. A gauge of this type enables the display of the precise lateral position of the pin support bracket 46, for example to within 0.0001 inch.

The left pin support bracket 47 is not moved by the rotation of the lead screw, but is a follower bracket adapted to be guided by the guide rods 44, 45 to be easily laterally manually movable by an operator.

Each of the pin support brackets is provided with a front guide surface 59 on which a vertically movable slide 60 is supported. Each slide has a vertically extending slot 61 though which a clamp screw 62 extends into the respective pin support block. A hand knob 63 on the screw enables the operator to readily clamp the slide 60 at any desired vertical position.

Figure 4:
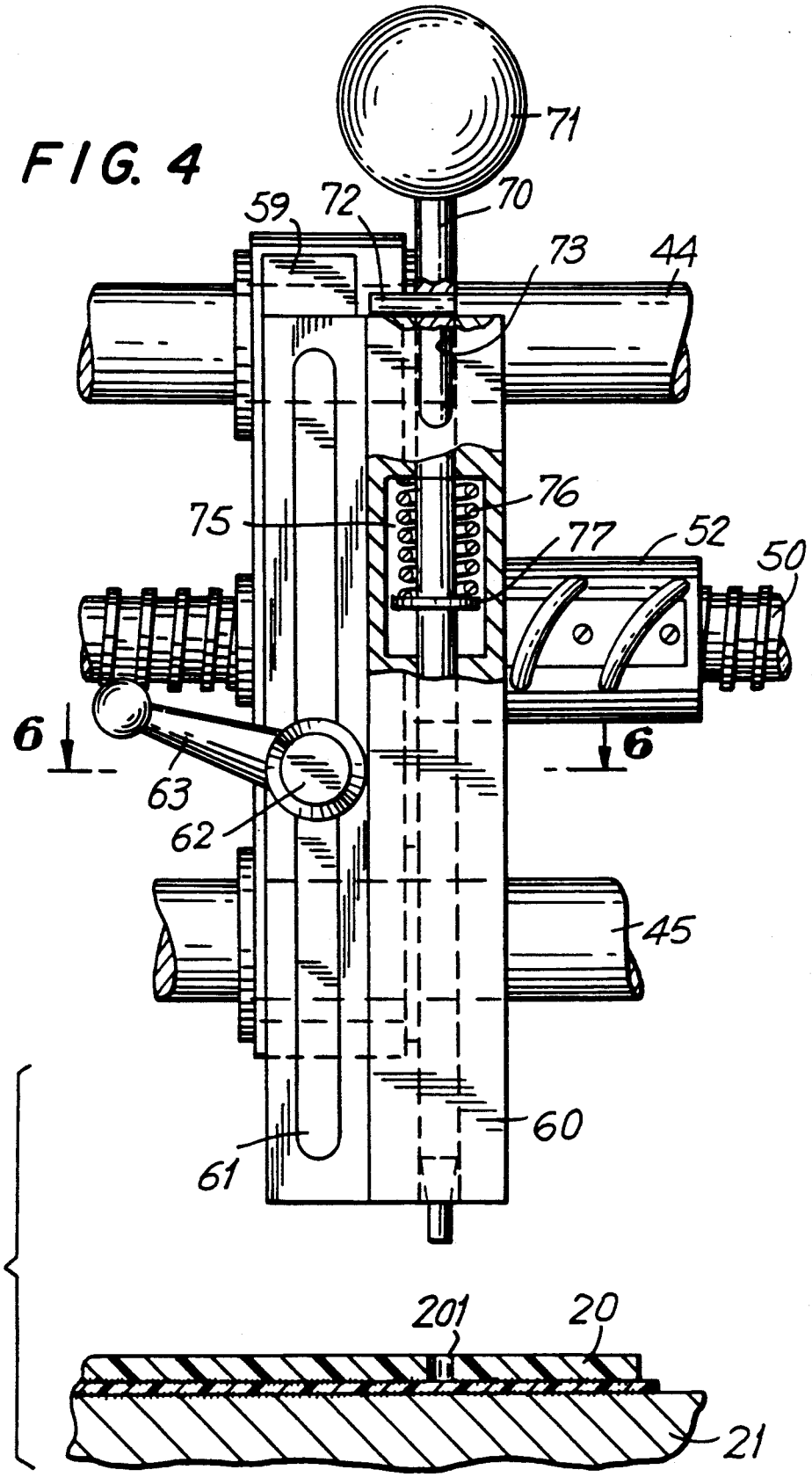
FIG. 4 is an enlarged front view of a pin support bracket of FIG. 1.
Figure 5:
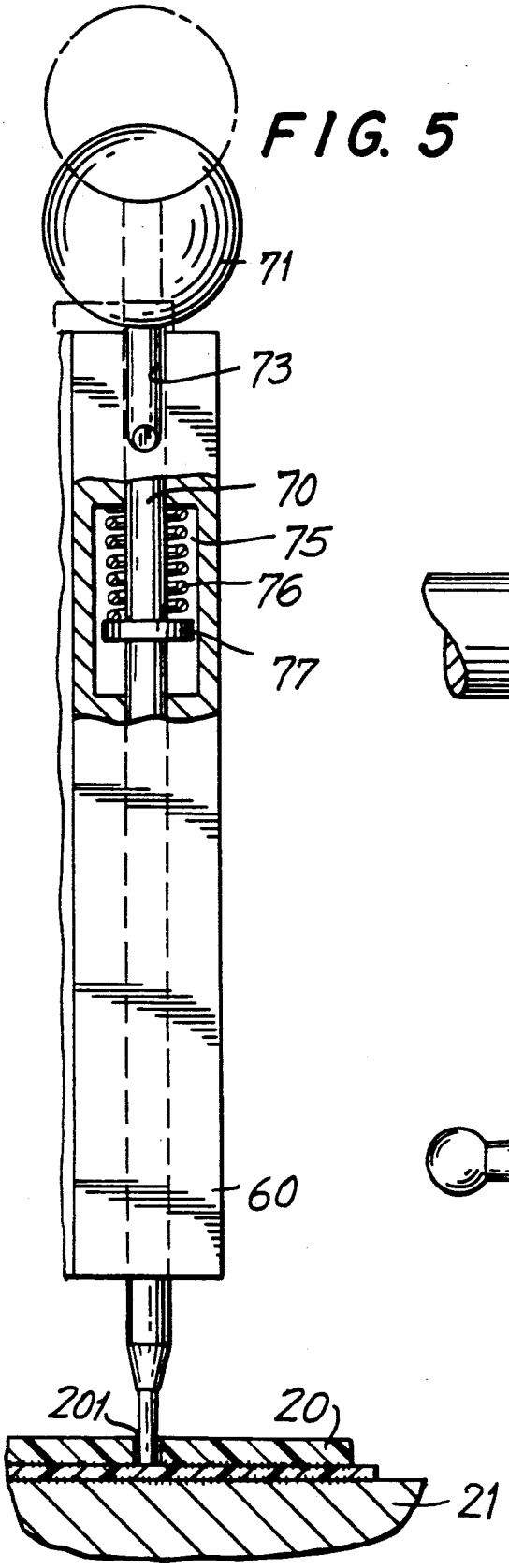
FIG. 5 is a front view of the slide of a pin support bracket of FIG. 1, in its lower position.
Figure 6:
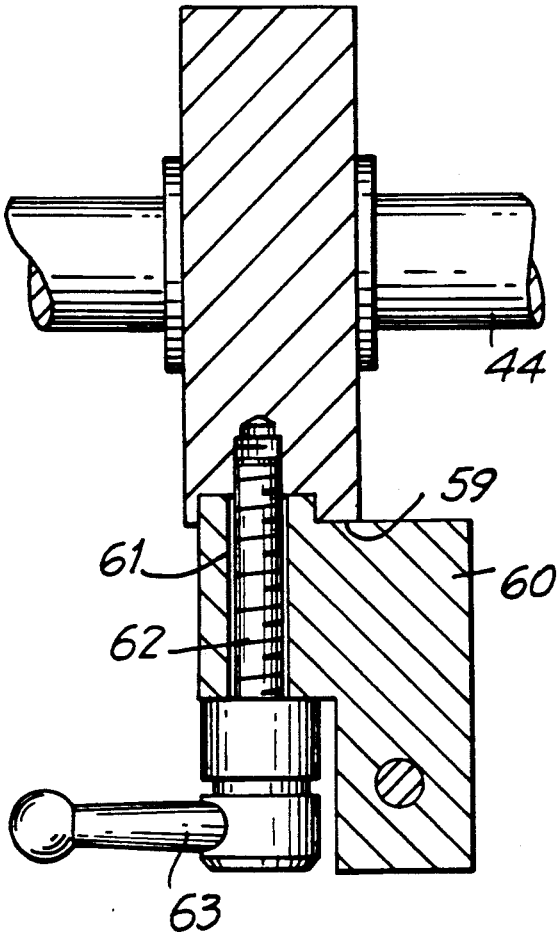
FIG. 6 is a cross sectional view of a pin support bracket, taken along the line 6—6 of FIG. 4.

A vertical bore in each slide 60 is aligned with the axis of a printing cylinder mounted in the apparatus, and a register pin 70 extends through each of these guide holes. The register pins extend from the top and bottom of the respective slide, and a hand operating knob 71 is mounted on the top of the register pins. Each pin 70 has a stop pin 72 extending perpendicular therefrom, at a distance spaced from the respective hand operating knob. A slot 73 is provided at the front upper edge of the slide, for receiving the respective stop pin 72. This arrangement thereby provides upper and lower end positions for the register pin. At the upper position of the register pin, the register pin is pulled upwardly and rotated so that the stop pin rests against the top of the respective slide, as shown in FIG. 4. At the lower position of the register pin, the stop pin 72 engages the lower end of the slot 73, as illustrated in FIG. 5, to inhibit the register pin from further downward movement.

The register pin 70 is preferably spring biased downwardly, by conventional means. For example, as illustrated in FIGS. 4 and 5, the register pin 70 may extend in a recess 75 in the slide, within which a compression spring 76 extends between a lower surface of the recess and a ring 77 affixed to the shaft of the pin.

The proof cylinder 100 is mounted rearwardly of the printing cylinder, on bearings, to extend between left and right supports 102, only the right support of which is illustrated. These supports are supported on bearings 103 for forward/backward movement, on guides 104 on the inner surfaces of the end plates 23, 24. A manually operable wheel 105 is affixed to the right end of the shaft of the proof cylinder, and a slot 110 is provided in the end plate 23, through which the shaft 106 extends, in order to permit the forward/rearward movement of the wheel shaft and the proof cylinder 100. An adjustment shaft 120 for the supports 102 is supported on bearings mounted to the end plate 23, and the shaft 120 has a worm gear 125 that engages a rack 126 on the bottom of the support 102, to permit the supports to be moved by turning the hand wheel 130. The shaft 120 may also be coupled via gears 127, 128 and shaft 129 to a worm gear/rack arrangement (not shown), to positively move the left support in the forward/backward direction, in response to the rotation of the hand wheel 130. A gear box 140 is mounted on the support 102, for coupling a gear 141 rotatable with the proof cylinder to the operating gear 145 of the printing cylinder. The gear box 140 includes a removable gear 146 engaging the gear 145, enabling the use of different gears for adapting the assembly for the mounting of flexographic plates on printing cylinders having different diameters.

A micrometer 150 is mounted to the end plate 23, the micrometer having a probe engaging a gauge surface 151 on the support 102, to permit the indication of the angular position of the proofing cylinder.

OPERATION

A printing cylinder 21, upon which one or more flexographic printing plates are to be mounted, is first mounted in the register system, with its shaft supported on the bearing 33 and held by the bearing 36. Any eccentricity of rotation of the printing cylinder 21 may be determined at this time, using the micrometer 150, by rotating the cylinder by means of the hand wheel 105. The information obtained in this test may be employed when the printing cylinder is employed in a printing press.

The slides 60 must be adjusted so that their upper and lower positions correspond to the diameter of the printing cylinder. For this purpose, the slide of each of the pin support brackets 46, 47 is loosened, with the respective register in its lower position, until the register pin thereof just contacts the surface of the printing cylinder. The respective hand knob 63 is then tightened, and the register pin withdrawn from the surface of the printing cylinder by lifting the operating knob 71. The register pin is held in its upper position by rotating it until the stop pin rests upon the upper surface of the slide, as seen in FIG. 4.

It is also necessary to adjust the right pin support bracket so that its register pin is located at a predetermined, reproducible location along the axis of the printing cylinder. For this purpose, the right pin support bracket is first brought to a central reference position by rotating the hand wheel 51. The reference position may be defined by a marking on the printing wheel or a marking on the register system with which the right pin support can be aligned.

The circumferential position of the printing cylinder, on which the printing plate is to be mounted, can be selected by rotation of the hand wheel 105, for example with reference to the readout of the gauge 53. For this purpose, the gauge may also be coupled to sense the rotation position of the cylinder.

The flexographic printing plate is provided with two register holes, 200, 201, adjacent opposite sides thereof, these holes being positioned to be accurately aligned in the longitudinal direction of the printing cylinder. The desired position of the flexographic printing plate may be defined by specifying the distance that the right hand hole 201 should be displaced from the center, or other reference location, of the printing cylinder. Accordingly, the gauge 53 is reset, by conventional means, to show zero displacement, and the right pin support 40 is now moved, by rotation of the hand wheel 51 until the gauge 53 displays the desired displacement.

A layer 210 of a double sided contact adhesive tape is provided on the printing cylinder 21, in the region where the flexographic printing plate is to be mounted. In the preferred method of mounting the flexographic plate onto the layer 210, a non-stick sheet (not shown) is first placed on the part of the double sided tape forwardly of the register pins. The flexographic plate is now laid on the non-stick sheet, with the hole 201 therein aligned with the register pin of the right pin support bracket. This may be effected by lowering the pin into the hole 201 of the flexographic plate. In order to align the other side of the flexographic plate, the plate is rotated, if necessary until the pin of the left pin support bracket can be lowered into the hole 200 on the left side of the plate. This alignment may require the lateral manual movement of the left pin support bracket to align its register pin with the hole 200. The alignment of the left register pin thus enables squaring of the printing plate in a simple manner. The rear edge of the printing plate may now be pressed down against the rear of the adhesive layer, to fix the position of the printing plate. The two pins 60 may now be raised, the front of the plate raised, the non-stick paper pulled out, and the front of the plate pushed down against the double sided tape. The printing plate 20 is now firmly and accurately mounted on the printing cylinder. If no further printing plates are to be mounted thereon, it can be proofed by applying the desired colored ink to the plate, and printing the plate on paper or the like on the proofing cylinder 100. If the print is satisfactory, the printing cylinder 21 may be removed from the register for assembly in a printing press.

The invention thereby provides a method and apparatus employing two registration points for accurately and reproducibly registering a flexographic printing plate in a minimum time. Accuracy of location of 1/1000 inches is readily achieved. Such registration is achievable, for example, in less than a minute. A number of printing plates may be mounted and accurately registered anywhere on the printing cylinder, so that is not necessary to provide the artwork for a single large, and expensive, printing plate. The setup of the smaller plates may be changed, as desired, and it is not necessary to locate the plates at positions predetermined by the use of pins or the like in the cylinder itself.

The system of the invention is readily adaptable to registering of different diameter cylinders, since the positions of the registration pins can be adjusted, and different gears may be readily employed to couple the gearbox to the gear of the printing cylinder.

The system of the invention also permits proofing of the printing plate in a simple manner. This is advantageous since, for example, if in the proofing process, a low spot is detected in the printing plate, corrections can be made before the printing plate is mounted on a printing press, thereby preventing the necessity of wasting valuable time in the operation of an expensive printing press.

The control of the system in accordance with the invention may also be effected automatically, using computer control. For example, the parameters for a given setup may be stored, so that they can be retrieved for later use. In such computer control, the pins may be coupled to motors or the like so that they can be automatically set to desired locations, and for different diameter cylinders.

While the invention has been disclosed and described with reference to a single embodiment, it will be apparent that variations and modification may be made therein, and it is therefore intended in the following claims to cover each such variation and modification as falls within the true spirit and scope of the invention.

What is claimed is:

1. A system for registering a flexographic printing plate on a printing cylinder, comprising frame means for rotatably mounting a printing cylinder, first and second registration pins, means for mounting said registration pins for movement longitudinally of a printing cylinder mounted in said system, means for displaying the longitudinal position of at least one of said registration pins, said mounting means comprising means for adjusting said pins to a first position abutting said cylinder and a second position spaced from said cylinder.

2. The system of claim 1 wherein said mounting means comprises guide means extending longitudinally of a printing cylinder mounted in said system, first and second brackets mounted on said guide means, means for mounting said first and second registration pins to said first and second brackets, respectively, and lead screw means for adjustable positioning said first bracket on said guide means.

3. The system of claim 2 wherein said means for mounting said registration pins comprises slide means on said brackets, means for adjustable positioning said slide means with respect to said printing cylinder, and means for mounting said pins to said slide means.

4. The system of claim 3 wherein said means for mounting said pins to said slide means comprises means for resiliently urging said pins toward a printing cylinder mounted in said system, and stop means for holding said pins at a position away from said printing cylinder.

5. A method for mounting a flexographic printing plate to a printing cylinder, comprising providing said printing plate with first and second holes adjacent opposite sides thereof, positioning a first pin adjacent a predetermined location on said printing cylinder, aligning said first hole with said first pin and moving said first pin to enter said first hole, then aligning said second hole with said second pin and moving said second pin to enter said second hole, then adhering said printing plate to said cylinder and then withdrawing said pins from said holes.

6. The method of claim 5 wherein said step of positioning said first pin adjacent said predetermined position comprises aligning said first pin with a reference location on said cylinder, then moving said first pin to said predetermined location while measuring the displacement of said first pin from said reference location.

7. A system for registering a flexographic printing plate on a printing cylinder, comprising frame means for rotatably mounting a printing cylinder for rotation about a given axis, a plurality of brackets, means for mounting said brackets for movement longitudinally of said axis, separate pin mounting means mounted to said brackets to have adjustable displacements with respect to said axis, a plurality of registration pins, mounting means for mounting said registration pins to separate pin mounting means, said mounting means including means for resiliently biasing said pins toward a first position and means for selectively holding said pins at a second position spaced further from said axis than said first position, whereby said pins may be selectively adjusted to be spaced from a cylinder mounted in said system and to resiliently engage said cylinder mounted in said system, and means for displaying the longitudinal position of at least one of said pins.

8. The system of claim 7 wherein said means for mounting said brackets comprises guide rods mounted to said frame means for guiding said brackets for movement longitudinally of said axis, and further comprising drive means for moving one of said brackets longitudinally of said axis to the exclusion of at least another of said brackets.

9. The system of claim 8 wherein said drive means comprises a lead screw rotatably mounted to said frame means.

10. The system of claim 8 wherein said display means is coupled to said lead screw to display the angular displacement thereof.

11. The system of claim 7 wherein said pin mounting means comprise slides, and means for adjusting the distance between said slides and said axis.

12. The system of claim 7 wherein said mounting means for mounting said registration pins to separate pin mounting means comprises a hole extending through said pin mounting means radially of said axis, said resilient biasing means comprises a spring for biasing said pin toward said axis, and said means for selectively holding said pins at a second position spaced further from said axis than said first position comprises a stop pin extending laterally of said pin, said pin being rotatable, and a stop surface on said pin holding means for holding said pin at said second position at a predetermined angular displacement of said pin.

13. A method for mounting a flexographic printing plate to a printing cylinder comprising providing said printing plate with first and second holes adjacent opposite sides thereof, moving a first pin longitudinally of said cylinder to a predetermined location with respect to said printing cylinder, placing said flexographic plate on said cylinder with an intervening non-stick medium aligning said first hole of said printing plate with said first pin and moving said first pin to enter said first hole, then, while said first pin is in said first hole, moving said plate to align said second hole with said second pin, then moving said second pin to enter said second hole, then removing said non-stick medium from between said cylinder and printing plate and adhering said printing plate to said cylinder and then withdrawing said pins from said holes.

14. The method of claim 13 wherein said step of moving said plate to align said second hole with said second pin comprises rotating said printing plate about said first pin.

* * * * *